US010789665B2

(12) United States Patent
Comello

(10) Patent No.: US 10,789,665 B2
(45) Date of Patent: Sep. 29, 2020

(54) CONTROL SYSTEM FOR OPTIMISING EMERGENCY MULTI-STOREY BUILDING STAIRWELL EVACUATION

(71) Applicant: Evacusmart IP Pty. Ltd., Sylvania, NSW (AU)

(72) Inventor: Allan John Comello, Sylvania (AU)

(73) Assignee: Evacusmart IP Pty Ltd, Sylvania (AU)

( * ) Notice: Subject to any disclaimer, the term of this patent is extended or adjusted under 35 U.S.C. 154(b) by 5 days.

(21) Appl. No.: 15/772,228

(22) PCT Filed: Oct. 28, 2016

(86) PCT No.: PCT/AU2016/051016

§ 371 (c)(1),
(2) Date: Apr. 30, 2018

(87) PCT Pub. No.: WO2017/070741

PCT Pub. Date: May 4, 2017

(65) Prior Publication Data

US 2018/0315150 A1 Nov. 1, 2018

(30) Foreign Application Priority Data

Oct. 30, 2015 (AU) ..... 2015904472

(51) Int. Cl.
*G06Q 90/00* (2006.01)
*G08B 7/06* (2006.01)
(Continued)

(52) U.S. Cl.
CPC ..... *G06Q 90/205* (2013.01); *A62B 3/00* (2013.01); *G08B 7/066* (2013.01); *A62B 5/00* (2013.01)

(58) Field of Classification Search
CPC ..... G06Q 90/205; A62B 3/00; A62B 5/00; G08B 7/066
See application file for complete search history.

(56) References Cited

U.S. PATENT DOCUMENTS 3,818,635 A * 6/1974 Morita ..... A62B 3/00 49/2
5,979,607 A 11/1999 Allen
(Continued)

FOREIGN PATENT DOCUMENTS

CN 202615547 U 12/2012
CN 103041522 A 4/2013
(Continued)

*Primary Examiner* — Robert E Fennema
*Assistant Examiner* — Jonathan Michael Skrzycki
(74) *Attorney, Agent, or Firm* — Brooks Kushman P.C.

(57) ABSTRACT

A control system for optimising emergency multi-storey building stairwell evacuation, the system includes an occupant tracking subsystem configured to monitor the locations of building occupants within a building as the occupants move between floors of the building so as to be able to continuously calculate the number of occupants on each floor of the building at any time, such that, during an emergency. The control system is configured and able to, using an access door controller subsystem: control the closing of a plurality of access doors of a stairwell; and control the successive opening of certain access doors of certain floors of the stairwell in accordance with an evacuation plan. Wherein the evacuation plan is dynamically configured in accordance with the calculated number of occupants on each floor of the building.

19 Claims, 1 Drawing Sheet

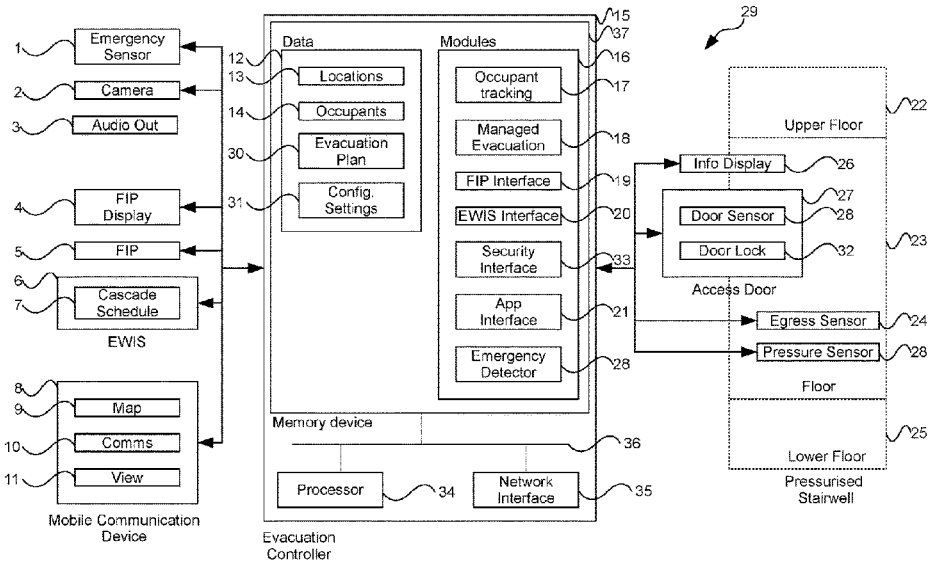

(51) Int. Cl.
*A62B 3/00* (2006.01)
*A62B 5/00* (2006.01)

(56) References Cited

U.S. PATENT DOCUMENTS

| | | | | |
|---|---|---|---|---|
| 7,182,174 | B2 | 2/2007 | Parrini et al. | |
| 2004/0163325 | A1* | 8/2004 | Parrini | B66B 5/022 52/1 |
| 2007/0024708 | A1 | 2/2007 | Lin et al. | |
| 2012/0047083 | A1 | 2/2012 | Qiao et al. | |
| 2014/0167969 | A1* | 6/2014 | Wedig | G08B 7/066 340/584 |
| 2014/0222329 | A1* | 8/2014 | Frey | G08B 7/066 701/423 |
| 2014/0248833 | A1* | 9/2014 | Royle | F24F 11/0001 454/257 |

FOREIGN PATENT DOCUMENTS

| | | | |
|---|---|---|---|
| CN | 104282185 | A | 1/2015 |
| EP | 1433735 | A1 | 6/2004 |
| GB | 2523129 | A | 8/2015 |
| JP | 2013238071 | A | 11/2013 |

* cited by examiner

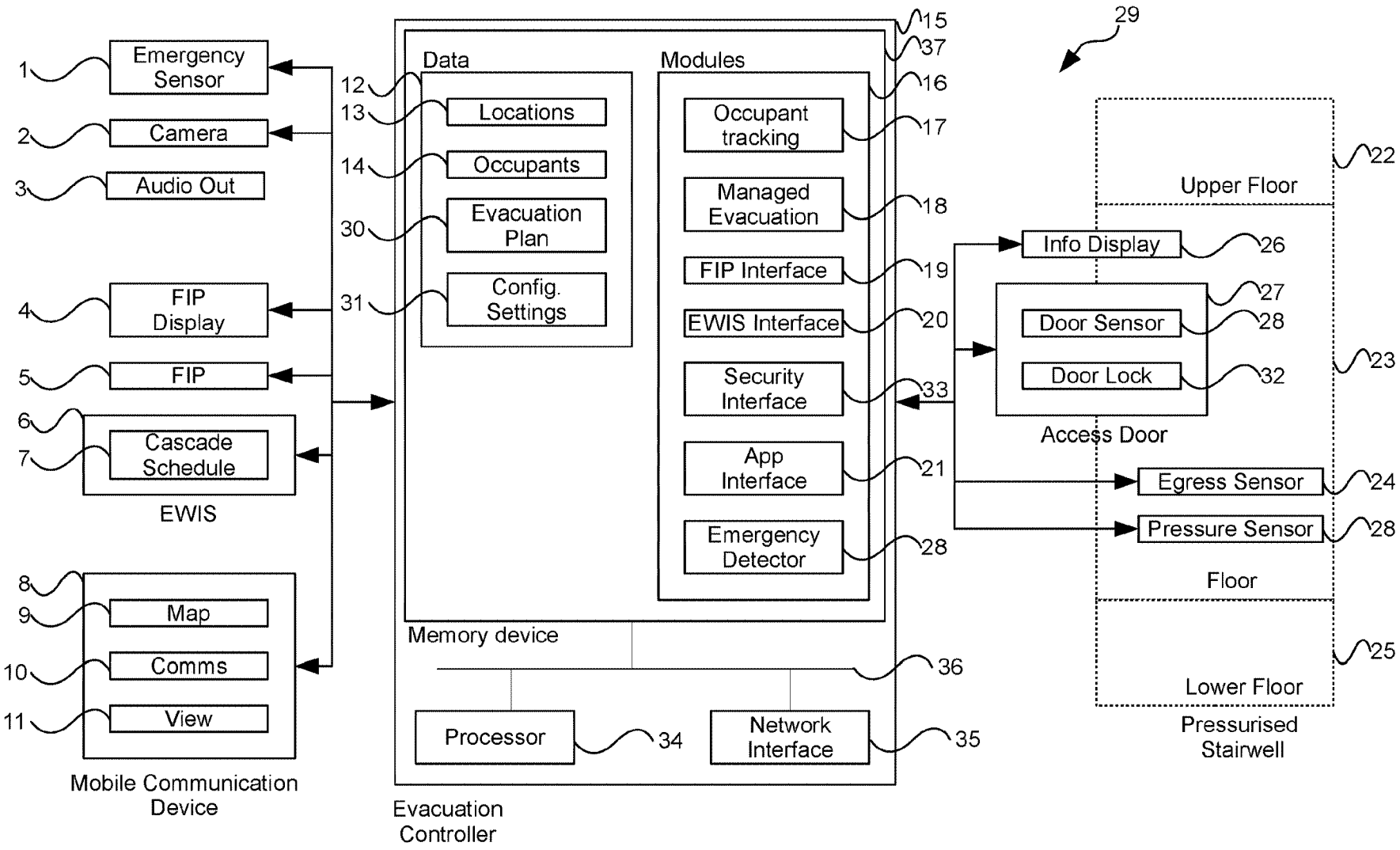
29
22
23
24
28
25
Upper Floor
Info Display
26
27
28
32
Door Sensor
Door Lock
Access Door
Egress Sensor
Pressure Sensor
Floor
Lower Floor
Pressurised Stairwell
15
37
16
17
18
19
20
33
21
28
36
35
Modules
Occupant tracking
Managed Evacuation
FIP Interface
EWIS Interface
Security Interface
App Interface
Emergency Detector
Network Interface
Data
Locations
Occupants
Evacuation Plan
Config. Settings
Memory device
34
Processor
Evacuation Controller
12
13
14
30
31
Emergency Sensor
Camera
Audio Out
FIP Display
FIP
Cascade Schedule
EWIS
Map
Comms
View
Mobile Communication Device
1
2
3
4
5
6
7
8
9
10
11

CONTROL SYSTEM FOR OPTIMISING EMERGENCY MULTI-STOREY BUILDING STAIRWELL EVACUATION

CROSS-REFERENCE TO RELATED APPLICATIONS

This application is the U.S. national phase of PCT Application No. PCT/AU2016/051016 filed on Oct. 28, 2016 which claims priority to Australian Patent Application No. AU 2015904472 filed on Oct. 30, 2015, the disclosures of which are incorporated in their entirety by reference herein.

FIELD OF THE INVENTION

The present invention relates to building emergency evacuation systems and in particular, but not necessarily entirely, to a control system for optimising emergency multi-storey building stairwell evacuation.

BACKGROUND AND SUMMARY OF EMBODIMENTS

Conventional building emergency evacuation techniques typically utilise an emergency warning intercom system (EWIS) to issue instructions for occupants to evacuate a building. Such a process is typically overseen by designated fire wardens.

Fire wardens are delegated certain tasks, such as aiming to manage the swift and orderly evacuation from a building, ascertaining the number of occupants remaining in certain areas of a building, informing emergency personnel and the like.

However, such existing building emergency evacuation techniques are unreliable and unpredictable, including for reasons of relying on human fire wardens. Many emergency situation studies have shown loss of life on account of human error, such as from fire wardens who are absent, or who panic or who are unable to receive and process all relevant information, such as the location of occupants, the location of the hazard (such as fire), emergency and the like.

D1 (U.S. Pat. No. 8,281,901 B2 (KAWAI et al.) 9 Oct. 2012) discloses (see Abstract) an evacuation operation control section that controls opening and closing of an access door adjacent to an elevator landing based on information from a passenger detector for detecting a passenger at the elevator landing and information on a fire situation in a vicinity of the elevator landing.

D2 (KR 20120029536 A (HWANG) 27 Mar. 2012) discloses (see Abstract) an automatic control device for access doors to provide persons inside a building with an evacuation route in case of a fire by selectively opening and closing access doors. The automatic control device for the access doors comprises multiple fire occurrence recognition devices and an access door control device. The fire occurrence recognition devices recognize fire occurrence through fire alarming devices and transmit wireless fire occurrence signals. The access door control device receives the wireless fire occurrence signals from the fire occurrence recognition devices and automatically and selectively opens and closes access doors (30*a*,30*b*,31).

D3 (JP 2015074921 A (MITSUBISHI ELECTRIC BUILDING TECHNO SERVICE CO LTD.) 20 Apr. 2015) discloses (see Abstract) a security system that prevents a decline in security and enables a larger number of persons to evacuate in a building, comprising: a plurality of locking devices 41 each of which is installed corresponding to each of a plurality of doors for opening/closing doorways formed in a plurality of management compartments in a building, respectively and each of which is displaced between a locking position for locking the door and an unlocking position for unlocking the door; a plurality of locking drive devices 42 for displacing the respective locking devices 41; a locking drive control device 11 to which evacuee number information indicating the number of evacuees entering the building is input and that controls the operation of each of the locking drive devices 42; and a reception device 12 for receiving an evacuee reception command. When the reception device 12 receives the evacuee reception command, the locking drive control device 11 controls the respective locking drive devices 42 in a preset order on the basis of the evacuee number information so that each of the locking devices 41 is displaced from the locking position to the unlocking position.

D4 (US 2014/0167969 A1 (WEDIG et al.) 19 Jun. 2014) discloses (see Abstract) a method includes receiving, at a server, sensed data from a sensor located in a structure, wherein the sensor is part of an evacuation system for the structure. The method also includes determining, based on the sensed data, whether a threshold relative to the sensed data has been exceeded. The method further includes providing a notification if it is determined that the threshold is exceeded.

Now, in accordance with one aspect, there is provided a control system for optimising emergency building stairwell evacuation, the system comprising an occupant tracking subsystem configured to monitor the locations of building occupants within a building as the occupants move between floors of the building so as to be able to continuously calculate the number of occupants on each floor of the building at any time.

As such, during an emergency, the control system is configured and able to close all access doors of an egress stairwell using an access door controller subsystem; and successively open access doors of certain floors of the stairwell in accordance with an evacuation plan and wherein the evacuation plan is dynamically configured in accordance with the calculated number of occupants on each floor of the building.

As such, in this embodiment, the present control system is able to dynamically optimise the evacuation process depending on the locations of occupants within a building.

Furthermore, the present control system is able to do so without substantially compromising the pressurisation of the stairwell.

Furthermore, the present control system is able to reduce congestion within the stairwell by controlling access to the stairwell in an orderly manner.

Furthermore, in certain embodiments, the present control system is able to monitor the egress rate of occupants so as to continuously update the evacuation plan accordingly.

Now, in contradistinction, D1 is directed to the problem of evacuees being stranded at lift landing during an emergency. The solution of D1 is to leave access doors open and only to close the access doors if contamination (smoke) is detected unless a passenger is detected at the elevator landing.

Specifically, D1 discloses "If the elevator landing is not contaminated, the access door 7 is left open (Step S2) and the judgment of the presence/absence of contamination of the elevator landing is continued." D1 further discloses that "If contamination of the elevator landing is verified, it is judged whether or not a passenger is present at the elevator landing based on information from the camera controller 5 (Step S3). Then, when there is no passenger, a door closing command for the access door adjacent to the elevator landing contaminated by smoke is output."

As such, D1 describes a simplistic egress located sensor (camera controller 5) to automatically open an access door on demand if closed. However, the camera controller 5 of D1 cannot be equated to the occupant tracking subsystem of the present system in that the camera controller 5 of D1 cannot monitor the whereabouts of building occupants within a building as the occupants move between floors of the building so as to be able to continuously calculate the number of occupants on each floor of the building at any time. For example, during an emergency situation, most of the occupants of a floor may be away from the lift landing, such as working at their desks, and therefore the system of D1 cannot know the whereabouts of these occupants, let alone configure an evacuation plan accordingly.

As such, whereas the system of D1 may haphazardly open certain closed access doors as occupants rush towards the exits, the present control system is characterised from D1 in being able to implement an orderly access door evacuation plan that is dynamically configured in accordance the number of occupants of each floor of the building.

For example, the present control system could be configured so as to evacuate the entire building within 10 minutes wherein, by knowing the number of occupants of each floor of the building at the time of an emergency, the present control system is able to successfully open the access doors for a duration proportionate with the number of occupants in each floor so as to meet the 10 minute evacuation timeframe. Further for example, by knowing the number of occupants of each floor of the building at the time of an emergency, the present control system is able to control the access doors so as to prevent congestion within the fire stairs.

Furthermore, D1 suffers from the deficiency in that the stairwell doors are left open by default. Specifically, D1 fails to disclose the claimed feature wherein the present controller closes all access doors of an egress stairwell using an access door controller subsystem.

Such an approach of D1 is problematic firstly because the system of D1 would results in stairwell depressurisation. Indeed, D1 appears to be totally ignorant of such a problem. By way of contradistinction, during an emergency, the present control system is able to maintain pressurisation of the stairwell to reduce smoke inhalation, visibility degradation and the like for evacuees within the stairwell.

Furthermore, D1's leaving of stairwell doors open by default is further problematic in exacerbating congestion wherein, for example, evacuees from an upper floor are hindered by protruding open doors and evacuees entering from lower floor stairwell doors in haphazard fashion.

Now, furthermore, D2 and D3 fail to disclose the claimed occupant tracking subsystem, let alone the successive opening an access doors in accordance with a dynamically configured evacuation plan as per the present control system.

Furthermore, with regards to D4, the occupancy unit 225 as disclosed in D4 is little different from the occupant sensor (camera system 5) of D1 described above. Specifically, the embodiments described in D4 describe the occupancy unit 225 as being a sensor configured only to detect the presence of an occupant which is described in various embodiments of D4 as comprising motion detectors, cameras, carbon dioxide, methane detectors, infrared sensors, audio detectors (see paragraphs 0039-0042 of D4).

The use of the sensors (occupancy unit 225) of D4 is deficient in that the whereabouts of occupants cannot be tracked wherein, for example, should a boardroom comprise an occupancy sensor/unit 225, should certain of those occupants leave to go to the bathroom for example (where presumably sensors would not be permitted anyways) it would not be possible to track the whereabouts of the occupants using the sensor system of D4 let alone count the number of occupants in each floor of a building at any time so as to use such information during an emergency.

As such, D4 does not disclose the claimed occupant tracking subsystem, let along being able to continuously calculate the number of occupants on each floor of the building at any time.

Furthermore D4 fails to disclose the controlling of stairwell doors, let alone the closing thereof and the successive opening thereof in accordance with an evacuation plan dynamically configured in accordance with the calculated number of occupants on each floor of the building.

Furthermore, the claimed invention involves and inventive step in light of references D1-D4 because there is no evidence from the prior art of record that the problem of optimising stairwell evacuation in accordance with the calculated number of occupants on each floor of the building let alone while not compromising the pressurisation integrity of the stairwell or preventing congestion bottlenecks within the stairwells was even recognised at the priority date.

As it cannot be reasonably established that the problems addressed by the present control system were even recognised, it is therefore not appropriate to even consider whether the person skilled in the art would have made reference to references D1-D4.

Furthermore, prior art references D1 D4 teach away from the present control system. Such is evident from D1 (the main cited reference) teaching away from the present control system by teaching the keeping open of access doors which would severely compromise the pressurisation integrity of the stairwell. Furthermore, D1 teaches the utilisation of elevators in an emergency, again teaching away from the present embodiments. Furthermore, D1 teaches the opening of the access doors upon demand if closed which would cause congestion for occupants evacuating from higher floors, further teaching away from the present control system.

Furthermore, even where it argued that such problems were recognised by the prior art, it is reasonable that the person skilled in the art would have rather arrived at a different solution given the differing and disparate solutions of the prior art. It cannot be reasonably established that the person skilled in the art would have arrived at the claimed invention as a matter of course by routine steps alone. Specifically, there is not even a suggestion in any of the prior art documents that would have rendered it obvious to try the claimed solution of implementing an occupant tracking subsystem configured to monitor the whereabouts of building occupants within a building as the occupants move between floors of the building so as to be able to continuously calculate the number of occupants on each floor of the building at any time, let alone using such data to close all access doors of an egress stairwell using an access door controller subsystem; and successively open access doors of certain floors in accordance with an evacuation plan and wherein the evacuation plan is configured in accordance with the calculated number of occupants on each floor of the building.

Furthermore, the system differences of the claimed control system as compared to the prior art are complex, and the complexity of overcoming technical obstacles via experimentation and the like are indicative of inventive step. Specifically, the implementation of the claimed feature of an occupant tracking subsystem configured to monitor the whereabouts of building occupants within a building as the occupants move between floors of the building at any time cannot be said to be in any way to be a mere design consideration, workshop improvement or the like. Furthermore, neither can the successive opening of access doors of certain floors in accordance with an evacuation plan or the dynamic configuration of the evacuation plan in accordance with the calculated number of occupants on each floor of the building be said to be a design consideration, workshop improvement or the like.

In accordance with further aspects, the control system further may comprise a stairwell pressure sensor and wherein the control system controls the access doors in accordance with a pressure reading from the pressure sensor.

The occupant tracking subsystem may be further configured for ascertaining the identities of the occupants.

The occupant tracking subsystem interfaces with a building access control subsystem and wherein the building access control subsystem has a plurality of security access points and wherein the occupant tracking subsystem may be configured for identifying the occupants in accordance with data received from the plurality of security access points.

The occupant tracking subsystem may be further configured for recognising occupants for ascertaining the identities of the occupants.

The occupant tracking subsystem may comprise at least one biometric reader.

The occupant tracking subsystem may comprise a facial image recognition subsystem.

The control system records occupant specific data and wherein, for at least one occupant identified by the occupant tracking subsystem, the control system may be configured for dynamically configuring the evacuation plan in accordance with occupant specific data associated with one occupant.

The occupant specific data may represent a disability status.

Dynamically configuring the evacuation plan in accordance with occupant specific data may comprise controlling a lift controller to send a lift car to the occupant's floor.

The control system may be configured to control the opening of access doors of certain floors for a time period proportionate to the respective calculated number of occupants.

The control system may further comprise an emergency sensor and wherein the control system may be configured for detecting the emergency in accordance with data received from the emergency sensor.

The emergency sensor may comprise at least one of least one of a smoke sensor, fire sprinkler activation sensor, break glass sensor and panic button sensor.

The control system may be configured for determining at least one of an emergency type and an emergency location and dynamically controlling the evacuation plan in accordance with the at least one of an emergency type and an emergency location.

The control system controls the access doors in accordance with a configuration setting stipulating the maximum number of access doors that may be open simultaneously.

The managed evacuation module may be configured to successively unlock the maximum number of access doors that may be opened simultaneously.

The evacuation plan data stipulates the order of the access doors to be successively unlocked.

The evacuation plan data stipulates the timing for the success of unlocking of the access doors.

The access door controller system may comprise an occupant information subsystem for providing information to the occupants.

The occupant information subsystem may comprise a display adjacent each access door.

The display displays information as to whether the adjacent access door should be open or closed.

The display displays a time remaining until the opening of the adjacent access door.

The access door controller subsystem may comprise a plurality of remotely controllable door locks for each of the access doors.

The access controller subsystem may comprise a plurality of remotely controllable door opening actuators for each of the access doors.

The system further may comprise a stairwell egress sensor subsystem configured to monitor the egress of occupants via the stairwell and wherein the control system may be configured for dynamically configuring the evacuation plan in accordance with the egress of occupants via the stairwell.

The egress sensor subsystem may comprise an egress sensor for each access door configured to count occupants exiting each access door.

The egress sensor subsystem may comprise an egress sensor for each access door configured to identify occupants exiting each access door.

The control system may further comprise an EWIS interface configured to interface with an EWIS system.

The EWIS interface may be configured to receive a cascade schedule from EWIS.

The control system may be configured for updating the evacuation plan in accordance with the cascade schedule.

The control system may further comprise a FIP output display interface to display emergency information at an FT for emergency services personnel.

The emergency information may comprise at least one of occupancy levels, occupant identities, evacuation status and access door unlock status.

The evacuation controller further may comprise a mobile communication device software application interface.

The mobile communication device software application interface may be configured to output emergency information to a software application executed by a mobile communication device.

The mobile communication device software application interface may be configured to output video data received from a plurality of cameras in the plurality of locations for display by a software application.

The mobile communication device software application may be configured to transmit audio data to allow the software application to allow voice communications with the plurality of locations.

It is to be understood that, if any prior art information is referred to herein, such reference does not constitute an admission that the information forms part of the common general knowledge in the art, in Australia or any other country.

The control system may be further configured for determining at least one of an egress rate or an egress state using the egress sensor subsystem and further dynamically update the evacuation plan accordingly.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which:

FIG. 1 shows A control system for optimising emergency multi-storey building stairwell evacuation in accordance with an embodiment of the present disclosure.

DESCRIPTION OF THE EMBODIMENTS

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the control system are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

Control system 29 for optimising emergency building stairwell evacuation

Turning now to FIG. 1, there is shown a control system 29 for automated optimising emergency building stairwell evacuation. As will be apparent from the ensuing description, control system 29 is adapted for optimising emergency multi-storey building stairwell evacuation in a manner that overcomes or at least substantially ameliorates the above described problems including those inherent in the utilisation of human fire wardens.

Specifically, the control system 29 is configured for managing emergency situations in substantial real time and, at the same time accounting for dynamic changes, including locations of occupants, hazards, rate of egress and the like. As will become apparent from the ensuing description, the system 29 is advantageous in certain embodiments in overcoming the problems of relying on human fire wardens who may be prone to panic, information overload lack of awareness and the like and/or conventional automated systems which are generally static in execution such as standardised evacuation schedules implemented by cascading EWIS systems which fail to take into account dynamic factors.

In one embodiment, control system 29 may be installed separately within a building in isolation to any existing systems such as data networks, so as to utilise a separate data architecture for data integrity purposes. In embodiments, the system 29 may still interface with existing systems through appropriate interface ports.

Now, the system 29 comprises an evacuation controller 15 in operable communication with a data network. The evacuation controller 15 may take the form of a computing device, such as an on premises or off premises computing device such as computer server, embedded controller.

As can be seen, the evacuation controller 15 comprises a processor 34 for processing digital data. Operably coupled to the processor 34 across a system bus 36 is a memory device 37. The memory device 37 is configured for storing digital data including computer program code. As such, in use, the processor 34 may load and execute computer code instructions from the memory device 37 and store data therein. In embodiments, the memory device 37 may take the form of one or a combination of volatile or nonvolatile memory, solid-state memory and disk drives including RAM, ROM and hybrid memory devices.

Now, the system 29 may further comprise access door controller subsystem for controlling the opening and closing and/or locking and unlocking a plurality of access doors 27 of a stairwell, including, in embodiments controllable door locks 32 of the respective access doors 27.

It should be noted that in embodiments, the access door controller subsystem may take on different embodiments within the purpose of scope of the embodiments described herein. In one manner, the access door controller subsystem may be passive in that it comprises an indicator, such as a light, information screen, audio instruction play out or the like, indicating to building occupants whether to open or close the associated access door 27.

In further embodiments, the access door controller subsystem may be mechanised wherein the door lock 32, such as a magnetic latch the like, of each respective access door 27 is controllable by the evacuation controller 15. In this manner, the controller 15 is able to physically lock or unlock each access door 27. Furthermore, the system 29 may comprise mechanical door actuators to open and close the associated access door 27.

The access door controller subsystem is in operable communication with the evacuation controller 15 across a data network. It should be noted that the system 29 may interface with any access control system fitted along the egress paths of the building.

Furthermore, the system 29 comprises at least one emergency detection sensor 1 in operable communication with the evacuation controller 15 across the data network. The emergency detection sensor 1 is configured for detecting an emergency such that the evacuation controller 15 may implement the managed evacuation process.

For example, the emergency sensor 1 may be a smoke detector, heat sensor or the like for the purposes of detecting a fire within the building. The emergency sensor 1 may comprise a fire sprinkler activation detector to detect the activation of a fire sprinkler system. The emergency sensor 1 may comprise a break glass, panic button or the like.

In embodiments, the emergency sensor 1 may interface with other systems so as to receive information indicative of an emergency. For example, the emergency sensor 1 may interface with a fire indicator panel 5 so as to receive information indicative of an emergency from the fire indicator panel 5. Of course, in embodiments where these external systems are not present, the system 29 may act in isolation.

In other embodiments, other types of emergency sensor 1 may be used additionally or alternatively, including heat sensors (which may be implemented by PIR sensors) blast detection sensors to detect explosions, shockwave sensors to detect noises such as from gunshots and the like. Additionally, video signal processing may be employed to detect occupants, crowds or chaos from video footage.

It should be noted that the emergency sensor 1 should be construed broadly as any mechanism for detecting or receiving data indicative of an emergency falling within the purposive scope of the embodiments described herein.

The system 29 further comprises and occupant tracking subsystem configured to monitor the locations of building occupants within the building as the occupants move between locations/floors of the building. As such, the occupant tracking subsystem is able to continuously monitor/calculate the number of occupants within each location or on each floor of the building at any time. As such, during an emergency, the evacuation controller 15 is able to dynamically configure the evacuation plan 30 in accordance with the calculated number of occupants in each location/floor.

The occupant tracking subsystem may comprise a combination of hardware and software. Specifically, the hardware may comprise an occupant detector for detecting and, in embodiments, identifying occupants. Furthermore, the occupant tracking subsystem may further comprise an occupant tracking module 17 configured to track the locations of occupants in accordance with data received from the occupant detector. Such data may then be stored in the data 12 within the locations table 13 and occupants table 14.

The evacuation controller 15 utilises the occupant tracking subsystem for ascertaining the locations of occupants within a building so as to be able to manage the evacuation process accordingly. In this manner, as opposed to utilising a set evacuation schedule, such as the cascaded evacuation of successive floors of a building, the controller 15 is able to take into account dynamic occupancy levels, such as, where for example, a particular floor of the building may be empty on account of a company event on that day such that the controller 15 need not necessarily waste time allocating the set time for evacuating the empty floor. In this manner, the system 29 is characterised in being able to account for dynamic scenarios, including dynamic changes and occupancy levels, types of emergent situations, locations of emergency situations and the like.

The occupant detector may comprise any device, sensor, subsystem or the like configured to detect and occupant. In further embodiments, the occupant detector may further ascertain the identity of an occupant.

Where the locations are divided between floors, the occupant detector ideally detects the movement of occupants between floors.

For example, the occupant detector may interface with a building access control system so as to be able to monitor the whereabouts of individuals taking the elevators utilising their security access cards. For example, should an occupant move from the 5th to the 11th floor, such would be ascertained from the access control system from the occupant's use of an access control card. Furthermore, the stairwell may be secured similarly by an access control system so as to be able to additionally monitor the whereabouts of occupants utilising the stairwell. In embodiments, as opposed to utilising an access control card, and occupant specific access code may be tracked.

In further embodiments, additional or alternative occupant detectors may be utilised.

For example, a camera imaging system may be utilised for tracking the whereabouts of occupants. For example, once having identified and occupant at a building entrance, the camera system may, by way of object recognition, video analysis and the like, track the occupant as the occupant moves around the building. In further embodiments, the camera system may implement facial recognition so as to be able to identify individual occupants.

In further embodiments, non-identity tracking devices may be strategically placed throughout the building, such as motion sensors, door reed switches, camera systems configured to count the number of occupants within a video frame and the like.

As such, the system 29 utilises a system of occupant detectors so as to be able to count or at least reasonably estimate the number of occupants at specific locations (such as floors) of a building.

For example, the location ascertaining module 17 may ascertain that there are 15 occupants on level three and 10 occupants on level four.

In embodiments, the occupant detectors may be configured so as to be able to detect the identities of occupants (such as from their smartcard devices, facial recognition, unique pin code or the like such that, at any one time, the location of a particular occupant may be ascertained from the system 29.

For example, the controller 15 may ascertain that Mary is on level three and John is on level two. Such occupant identification may be especially advantageous where occupants have special needs, such as being wheelchair-bound and cannot access the stairwell, for example. In this manner, the system 29 is able to identify the need for the enabling of a lift to be used only for the evacuation of the disabled or injured persons. Furthermore, for evacuation point roll calls, the locations of missing persons may be ascertained from the system 29.

The controller 15 further comprises an emergency detector module 28 for detecting an emergency using the at least one emergency detection sensor. In the illustrated embodiments described herein the emergency detector module 28 will be described with reference to detecting a fire on a particular floor of a building.

Now, the evacuation controller 15 may further comprises a managed evacuation module 18 for managing an emergency evacuation. Specifically, once the evacuation controller 15 has detected an emergency, such as a fire, the managed evacuation module 28 is configured for controlling at least the access door controller subsystem to control the access doors 27 in accordance with the evacuation plan data 30 from the data 12 and the ascertain locations of the plurality of occupants of the building. [110] Having generally describe the above technical architecture, there will now be described in exemplary scenario to illustrate the operation of the control system 29. It should be noted that these embodiments are exemplary only and that no technical limitation should necessarily be imputed to all embodiments accordingly.

Now, as alluded to above, during everyday use, the controller 15 continuously tracks the whereabouts of occupants within a building. In this exemplary embodiment, the building comprises smartcard proximity readers installed at both the elevators and stairwells. As such, as occupants move between floors of the building, the evacuation controller 15 continuously monitors the whereabouts of the occupants and stores such data within the data 12.

As such, for example, that any one time, the controller 15 is able to provide the number of occupants on each floor of the building and also their identities.

Now, during an emergency, a fire may break out on the fifth floor of a building. In the embodiment shown in FIG. 1, the fifth floor is represented by floor 23, having lower floor 25 and upper floor 22.

The fire notification may be received by the controller 15 from an emergency sensor 1, such as a smoke detector, fire sprinkler subsystem or alternatively received from another subsystem, such as the FIP 5.

Now, the managed evacuation module 18 would then control the various access doors 27 in accordance with the emergency plan 30.

In one embodiment, the managed evacuation module 18 would firstly control the closing of the access doors 27 including for reasons of maintaining stairwell pressurisation and being able to control congestion as alluded to above.

As such, the managed evacuation module 18 may firstly control the access door controller subsystem to close or lock all of the door locks 32 of all of the respective access doors 27 of the stairwell.

In embodiments, certain of the access doors 27 may be ajar. In such case, the managed evacuation module 18 may send a notification to a responsible person to close the relevant door, such as by way of push notification to a mobile communication device. Additionally, or alternatively, adjacent each access door 27 may be provided an information display panel 26. In this embodiment, the managed evacuation module 18 may display information on the display panel 26 instructing the closing of the access door 27 for safety purposes. In a further embodiment, the managed evacuation module 18 may actually control a door closing mechanism, such as releasing an electromagnet or the like so as to attempt to close the ajar access doors 27.

In a normal scenario, in embodiments, the control system 29 may be configured such that should a door be held open for more than a predetermined amount of time, the control system 29 sends a warning or notification to the person at the door or to a person in authority to have the door closed.

It should be noted that in embodiments the information display 26 and other components may be provided as a unitary device such that, for example, the unitary device may comprise the information display 26, the egress sensor 24 and the like. In other words, various componentry may combined as an integral unit so as to aid in the installation process, locations of the components and the like.

Now, once the access doors 27 have been closed or locked, so as to substantially prevent occupants from simultaneously rushing to the stairwell from differing floors of the building, the managed evacuation module 18 may successively control the opening of certain access doors 27 so as to allow occupants within certain locations of the building to successively access the stairwell. In this manner, occupants are introduced into the stairwell successively so as to avoid bottlenecks and, in embodiments, also to maintain pressurisation.

For example, where the emergency detector module 28 has detected that the fire is on the fifth floor, the managed evacuation module 18 may firstly unlock the access doors 27 on the fifth floor so as to allow those occupants in the most immediate danger to exit first.

As alluded to above, the managed evacuation module 18 may implement the evacuation in accordance with an evacuation plan 30 within the data 12. In this regard, the evacuation plan 30 may specify that floors having specific emergencies, such as fire, are to be evacuated first.

Thereafter, the managed evacuation module 18 may unlock further access doors 27 so as to allow further occupants into the stairwell. For example, the evacuation plan 30 may stipulate that floors above a fire on to be evacuated first so as to allow those occupants in danger of the fire spreading to be evacuated subsequently. As such, the managed evacuation module 18 may unlock the upper floor 22 from the fifth floor 23 and successfully thereafter for the upper floors prior to unlocking the lower floors 25.

A default evacuation plan may be utilised configuring the controller 15 to, for example, allow the lower floors are to be evacuated first whereas, after a reasonable time, the upper successive floors are to be opened or vice versa.

In embodiments, the evacuation plan 30 may specify safe areas for the temporary location of occupants. For example, a building may comprise fire and smoke rated safetly locations into which the system 29 directs occupants during fire emergencies while the fire burns past. In further embodiment, the evacuation plan 30 may comprise differing exit routes, being especially advantageous should a conventional exit route be blocked such as by way of fallen debris, fire or the like. For example, by implementing dynamic routing, the control system 29 may take occupants down an initial flight of stairs in a first stairwell and then, were the remainder of the stairs of the first stairwell is blocked, such as by way of fire or the like, route the occupants across a particular floor to a second stairwell to complete the remainder of the floors and safety.

It should be noted that, in embodiments, so as to prevent panic especially from occupant uncertainty, the information display panel 26 may display information to reassure occupants. For example, the information displayed on the display panel 26 may specify the remaining time remaining prior to the opening of the adjacent access door 27. Furthermore, the information display panel 26 may display information relating to the current tasks being performed by the managed evacuation module 18, such as which floors are currently being evacuated. Other information may be displayed for occupants by the information display panel 26 accordingly.

In embodiments, additional information from building management staff, fire brigade may be displayed by the information display panel 26 or by an adjacent audio device.

Now, in one embodiment, the stairwell is a pressurised stairwell. In this manner, the configuration settings 31 may comprise settings stipulating the maximum number of access doors 27 that may be open simultaneously so as to not defeat the pressurisation of the pressurised stairwell as per the relevant standards.

It should be noted that in embodiments, the control system 29 is configured for controlling the pressurisation of the stairwell. For example, the control system 1 may adjusting fan speed to compensate for loss of pressurisation with any stairwell, including in accordance with the number of access doors 27 been currently open.

For example, the configuration settings 31 may stipulate that, given the size of the stairwell, no more than 2 access doors may be opened simultaneously. In such a case, the managed evacuation module 18, in accordance with the configuration settings 31 may open the access door 27 on the fifth floor 23 and of the upper floor 22 simultaneously.

In embodiments, the system 29 may comprise a pressurisation sensor 28 configured to measure the pressurisation state of the stairwell. In this manner, the managed evacuation module 18 may allow the simultaneous opening of access doors in accordance with pressure readings received from the pressure sensor 28.

In embodiments, the managed evacuation module 18 may be configured not to open further access doors until such time the previous access doors have been closed. For example, the managed evacuation module 18 may not open the access doors 27 on the seventh floor until such time that either or both of the access doors on the fifth and sixth floors have been closed. In this manner, the information display 26 on the fifth and sixth floors may instruct the occupants to close the door when the last occupant has exited. It should be noted that the information display panel 26 may be complimented with audio played out from an audio output device 3 so as to verbally instruct occupants to close the access doors.

Now, as alluded to above, the managed evacuation module 18 may be controlled to open the access door 27 in accordance with the number of occupants within certain locations as has been ascertained by the occupant location ascertaining module.

For example, when iteratively opening access doors of the stairwell, should the occupant location ascertaining module ascertain that there are no occupants on the 6 floor, the managed evacuation module 18 may skip opening the access door 27 of the sixth floor.

In embodiments, an emergency pushbutton or the like may be placed adjacent the access door 27 so as to allow undetected or unaccounted for occupants to signify their location within a particular location.

Furthermore, the managed evacuation module 18 may open the access doors 27 in accordance with the number of occupants on a particular floor or location. For example, where floor 23 has 20 occupants, the managed evacuation module 18 may open the access door 27 for three minutes whereas, for floor 22 comprising 40 occupants, the managed evacuation module 18 may open the access door for a longer period, such as 6 minutes, prior to opening success of access doors 27. In embodiments, the evacuation plan 30 may stipulate a maximum evacuation time wherein, during the emergency, the evacuation controller 15 would divide the maximum evacuation time per floor proportionately in accordance with the number of occupants.

However, in other embodiment, the managed evacuation module 18 may open access doors 27 for periods of time calculated in additional or alternative manners such as in accordance with the number of occupants remaining on a floor or by sensing the capacity of the stairwell using egress sensor 24.

It should be noted that differing types of egress sensor 24 may be applicable within the purposive scope of the embodiments described herein. In other words, the egress sensor 24 may be any sensor that is configured for counting, identifying, measuring the speed of egress and the like. In embodiments, traffic controls may be located within or adjacent the stairwell, such as by comprising stop/go indicator lights and the like. In this embodiment, the traffic controls may work in combination from the sensor data received from the egress sensor 24.

In the embodiment where the managed evacuation module 18 opens the access doors 27 for periods of time calculated in accordance with a number of occupants remaining on a floor or within a location, the evacuation controller 15 may count the number of occupants leaving the floor or location using the egress sensor 24 or occupant detector. For example, each access door may comprise a motion sensor, laser trip, image recognition system or other sensor configured to count the number of people exiting the access door 27.

As such, the managed evacuation module 18 may keep the access door 27 open until such time that all of or the majority of the occupants have left a particular floor prior to opening the next access door 27.

For example, where the occupant tracking subsystem has detected that there are 22 occupants on the fifth floor, the managed evacuation module 18 may open the access door 27 on the fifth floor until such time that the occupant detector has detected that all of the 22 occupants have left the fifth floor, or at least a majority of the occupants. For the former, where all of the occupants have left the floor, the managed evacuation module 18 may subsequently lock the access door 27. For the latter, where the majority of occupants have left the floor, such as where only 2 occupants remain on a floor, the managed evacuation module 18 may keep the door unlocked but then proceed to opening the next access door 27 on the adjacent floor 22 on the basis that the 2 occupants remaining with the fifth floor will not substantially imped the egress of the occupants leaving from the adjacent floor 22.

Furthermore, where the egress sensor 4 determines an egress rate through the stairwell, the controller 15 may dynamically increase or decrease the rate of execution of the evacuation plan accordingly. For example, should occupants be leaving the stairwell relatively quickly, the evacuation controller 15 may speed the evacuation process so as to save time.

In embodiments, the system 27 may comprise an emergency warning intercom system (EWIS).

The EWIS may play out emergency evacuation instructions utilising audio output devices 3 and a plurality of locations of the building. In embodiments, the EWIS may interface with a warden intercom phone (WIP) to allow wardens to issue verbal instructions.

In some instances, the EWIS may play out audio instructions in accordance with a cascade schedule 7 so as to, for example, iteratively instruct occupants on adjacent floors to evacuate successively.

As such, in embodiments, the evacuation controller 15 may interface with the EWIS 6 so as to retrieve the cascade schedule from the EWIS for the purposes of populating the evacuation plan 30 so that the managed evacuation module 18 may subsequently manage the evacuation process in accordance with a schedule substantially conforming to that of the cascade schedule 7 of the EWIS 6.

As can be appreciated, the evacuation controller 15 takes into account dynamic information such as occupancy levels and the like and therefore the evacuation schedule implemented by the evacuation controller 15 takes precedent to the preprogramed cascade schedule 7 of the EWIS 6.

In embodiments, and as alluded to above, as opposed to only detecting occupancy levels, the evacuation controller 15 may be configured to implement occupant identification and/or recognition. For example, and by way of the example provided above, utilising occupant recognition, the evacuation controller 15 may ascertain the identities of occupants at particular locations of a building.

Such has particular advantages where occupants have special needs. For example, Mary may be wheelchair-bound and therefore may not be able to exit via the stairwell. As such, a record is created in the occupants table 14 of the data 12 identifying Mary and recording her disability. As such, during an emergency event, while the other occupants may be evacuated by the stairwell, the evacuation controller may send a notification to emergency personnel alerting the emergency personnel to the fact that Mary is on the fourth floor and cannot access the stairwell. In other embodiments the managed evacuation module 18 may allow Mary's egress via disabled friendly exits, such as lift access and the like.

Occupant recognition may be performed in many manners, including those alluded to above. For example, at entry points, biometric readers may be placed so as to implement facial recognition, speech recognition, fingerprint recognition, retina scanning and the like. Furthermore, access control devices may record pin codes, proximity card UIDs and the like for uniquely identifying individuals.

In embodiments, these occupant recognition devices may be placed at various locations within the building so as to track the movements of occupants. For example, facial image recognition cameras may be placed adjacent lift shafts so as to recognise occupants moving from floor to floor so as to dynamically update the locations data 13 within the data 12 of the specific locations of specific occupants.

As alluded to above, in embodiments, the evacuation controller 15 may interface with the FIP 5 so as to receive information from the FIP 5, such as emergency information and the like. In embodiments, the evacuation controller 15 may output information for display on or adjacent the FIP 5 (or EWIS, BMS system of the like) to assist emergency personnel, such as firefighters and the like. As such, when attending a building, firefighters, inspecting the FIP 5, may gain further information from the evacuation controller 15, such as the current evacuation levels, identities of occupants and the like.

In an embodiment, the evacuation controller 15 may output data to an FIP display 14 configured to display information on or adjacent the FIP 5. The FIP display 14 may display a location schematic of the building comprising information relating to the number of occupants currently remaining at certain floors, the fire location, the unlock status of access doors 27 and the like. In this regard, any information which may be utilised by emergency personnel may be displayed by the FIP display 4.

In embodiments, the evacuation controller 15 may interface with a security system utilising security interface module 33. The security interface module 33 may be configured for cross correlating identities of occupants with external security systems for authorisation, monitoring purposes and the like.

As such, during the event of an emergency, such as a terrorist attack or the like, the evacuation controller 15 may use the external security system two cross correlate suspects or unauthorised occupants. For example, during a terrorist threat or suspicious fire, the system 12 may notify police that an unauthorised or suspicious occupant is on level 5.

In embodiments, the system 12 is configured to interface with external mobile communication devices or proprietary hardware devices so as to allow for the mobile interfacing with the system 29.

It should be noted that the external devices may be utilised by various responsible persons, such as security guards have any mobile communication device, the building management system or building administration having a computing console configured for interfacing with the app interface 21 and the like.

For example, users of the system 29 may download a software application for execution by a mobile communication device 8. As such, the software application may authenticate with the evacuation controller 15 for the purposes of receiving information and controlling the evacuation controller 15.

In one embodiment, the evacuation controller 15 comprises an app interface module 21 configured to control the interface with these software applications.

The software application may be utilised by various actors, including rescue personnel, such as firefighters and the like for ascertaining the evacuation state of the building and the like.

In one embodiment, the software application may display a map representation 9 representing the various locations of the building wherein the map is overlaid with important information, such as occupancy levels, occupant identities and the like. Such information may be substantially the same or a subset of the information displayed by the FIP display 4 as described above.

In further embodiments, the software application may allow for the communication with occupants via audio output devices 3 at various locations within the building. For example, should an occupant be on the fifth floor, the user of the software application may utilise the communications module 10 of the software application to communicate with the occupant on the fourth floor.

In embodiments the software application may allow for the real-time viewing of the interior of the building utilising viewing module 11 which receives video data from one or more cameras 2 located at various locations within the building.

In this manner, emergency personnel may view various locations of the building and communicate with occupants if necessary, such as a gather further information, issue instructions and the like.

It should be noted that variations and modifications may be made to the embodiments described above within the purpose of scope of the invention. Specifically, whereas stairwells have been described with reference to a preferred embodiment, the embodiments described herein may be applicable to other exit routes also. Furthermore, whereas multi-storey buildings have been described with reference to a preferred embodiment, certain embodiments may be applicable to single-storey buildings including residential and commercial developments or a mixture thereof.

Furthermore, whereas the embodiments described here and have been described primarily with reference to tracking occupants between floors, it should be appreciated that embodiments may track occupants by other locations, such as specific locations of floors, areas and the like. Furthermore, embodiments described herein may be applicable to buildings having multiple stairwell exits, multiple elevators and the like.

Furthermore, whereas controlling stairwell access doors has been described herein with reference to a preferred embodiment, embodiments may additionally or alternatively be employed for controlling other access routes, including elevators, or controlling instructional traffic controlling signage and the like.

As can be appreciated from the foregoing, certain embodiments described herein provide advantages in allowing for a dynamically configurable evacuation plan being superior when compared to conventional static staged evacuation EWIS methodologies. In this regard, certain of the present embodiments are able to dynamically take into account various factors, such as occupant locations, emergency types and locations, egress rates and the like so as to be able to analyse such so as to dynamically compute dynamic evacuation plan.

In certain embodiments, the present embodiments may comprise all of, or at least a subset of EWIS, FIP, CCTV, electronic signage, building management system, security system, motion detection, facial recognition, low voltage management, air conditioning management, stairwell pressurisation management, fire detection, smoke detection, chaos detection, single factor authentication, dual factor authentication and access control, which, in embodiment, may be controlled and analysed via the onsite server(s) and connection to cloud enabling secure/continuous remote monitoring, access and action to and from single and multiple users and or subscribers.

Interpretation

Wireless:

The invention may be embodied using devices conforming to other network standards and for other applications, including, for example other WLAN standards and other wireless standards. Applications that can be accommodated include IEEE 802.11 wireless LANs and links, and wireless Ethernet.

In the context of this document, the term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. In the context of this document, the term "wired" and its derivatives may be used to describe circuits, devices, systems, methods, techniques, communications channels, etc., that may communicate data through the use of modulated electromagnetic radiation through a solid medium. The term does not imply that the associated devices are coupled by electrically conductive wires.

Processes:

Unless specifically stated otherwise, as apparent from the following discussions, it is appreciated that throughout the specification discussions utilizing terms such as "processing", "computing", "calculating", "determining", "analysing" or the like, refer to the action and/or processes of a computer or computing system, or similar electronic computing device, that manipulate and/or transform data represented as physical, such as electronic, quantities into other data similarly represented as physical quantities.

Processor:

In a similar manner, the term "processor" may refer to any device or portion of a device that processes electronic data, e.g., from registers and/or memory to transform that electronic data into other electronic data that, e.g., may be stored in registers and/or memory. A "computer" or a "computing device" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. The processing system further may include a memory subsystem including main RAM and/or a static RAM, and/or ROM.

Computer-Readable Medium:

Furthermore, a computer-readable carrier medium may form, or be included in a computer program product. A computer program product can be stored on a computer usable carrier medium, the computer program product comprising a computer readable program means for causing a processor to perform a method as described herein.

Networked or Multiple Processors:

In alternative embodiments, the one or more processors operate as a standalone device or may be connected, e.g., networked to other processor(s), in a networked deployment, the one or more processors may operate in the capacity of a server or a client machine in server-client network environment, or as a peer machine in a peer-to-peer or distributed network environment. The one or more processors may form a web appliance, a network router, switch or bridge, or any machine capable of executing a set of instructions (sequential or otherwise) that specify actions to be taken by that machine.

Note that while some diagram(s) only show(s) a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Additional Embodiments

Thus, one embodiment of each of the methods described herein is in the form of a computer-readable carrier medium carrying a set of instructions, e.g., a computer program that are for execution on one or more processors. Thus, as will be appreciated by those skilled in the art, embodiments of the present invention may be embodied as a method, an apparatus such as a special purpose apparatus, an apparatus such as a data processing system, or a computer-readable carrier medium. The computer-readable carrier medium carries computer readable code including a set of instructions that when executed on one or more processors cause a processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

Carrier Medium:

The software may further be transmitted or received over a network via a network interface device. While the carrier medium is shown in an example embodiment to be a single medium, the term "carrier medium" should be taken to include a single medium or multiple media (e.g., a centralized or distributed data 12, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media.

Implementation:

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Means for Carrying Out a Method or Function

Furthermore, some of the embodiments are described herein as a method or combination of elements of a method that can be implemented by a processor of a processor device, computer system, or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

Connected

Similarly, it is to be noticed that the term connected, when used in the claims, should not be interpreted as being limitative to direct connections only. Thus, the scope of the expression a device A connected to a device B should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, FIGURE, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

The invention claimed is:

1. A control system configured to provide efficient emergency multi-storey building stairwell evacuation in a building, the system comprising:

an occupant tracking subsystem configured to monitor the locations of building occupants within the building, wherein the occupant tracking subsystem includes:

a camera system including a plurality of camera devices, wherein each camera device is positioned thereby to capture image data in a respective field of view, wherein the cameras are position such that the fields of view include: one or more regions at an entrance to the building; and one or more regions on each storey of the building including regions adjacent lift shafts;

a data store that is configured to maintain data representative of: (i) individual occupants identified within the building; and (ii) for each occupant, a current known location;

a computer system that processes data received from the plurality of camera devices, wherein the computer system is configured to:

(i) for each camera, apply a facial recognition process thereby to identify individual specific occupants in the field of view of each camera;

(ii) for each camera, each time an individual specific occupant is identified, update the data store such that for that specific individual occupant the data store records a current known location associated with that camera;

such that the computer system causes the data store to maintain current data representative of a number of occupants on each storey of the building as occupants move between storeys of the building, including via identification of specific individual occupant after they exit elevators;

a stairwell access control subsystem which is configured to:

control a state of a plurality of access doors of an evacuation stairwell, wherein for each there is an "evacuation state" in which the door is open for evacuation purposes and a "non-evacuation state" in which the door is closed for evacuation purposes; and a dynamic evacuation plan control subsystem which is configured to:

(i) access the data store thereby to determine a current number of occupants on each storey of the building;

(ii) generate an initial evacuation plan which defines an initial schedule for transitioning the access doors from the non-evacuation state to the evacuation state, wherein the schedule is defined thereby to allot a per-storey evacuation time proportionally between storeys based on the number of occupants on each storey of the building;

(iii) receive data representing egress of persons through a given one of the access doors which is the evacuation state on a given storey of the building; and (iv) dynamically modify the schedule in the case that the data representing egress demonstrates an increase or decrease in evacuation time for the given storey relative to the allotted per-storey evacuation time for that storey currently defined by the evacuation plan, such that the schedule is modified for transitioning a remaining subset of access doors from the non-evacuation state to the evacuation state, wherein the schedule is thereby modified to allot a per-storey evacuation time proportionally between the remaining storeys based on the number of occupants on each of the remaining storeys, wherein the stairwell access control subsystem which is configured to control the transition of each of the access doors from the non-evacuation state to the evacuation states in accordance with the schedule and modified schedule.

2. A control system as claimed in claim 1, wherein the control system is configured to control a plurality of display panels positioned adjacent access doors of the stairwell, thereby to cause the display panels to display information including time remaining prior to transition from the non-evacuation state to the evacuation state based on the schedule.

3. A control system as claimed in claim 1, wherein the occupant tracking subsystem is configured for ascertaining the identities of the occupants via the camera system that implements facial recognition, wherein a record is created in an occupants table identifying specific occupants having disabilities, such that during an evacuation event the control system sends a notification to emergency personnel alerting the emergency personnel of a location of a disabled building occupant.

4. A control system as claimed in claim 1, wherein the evacuation plan stipulates a maximum evacuation time, and wherein the schedule is defined to divide the maximum evacuation time into per storey evacuation allotted times proportionately in accordance with the calculated number of occupants on each storey of the building.

5. A control system as claimed in claim 1, wherein the control system is configured to control the transitioning to the evacuation state of access doors to the evacuation stairway of certain storeys for a time period proportionate to the respective calculated number of occupants.

6. A control system as claimed in claim 1, wherein the control system controls the state of access doors to the evacuation stairway in accordance with a configuration setting stipulating the maximum number of access doors that may be open simultaneously.

7. A control system as claimed in claim 1, wherein the evacuation plan stipulates the timing and/or order of the access doors to be successively transitioned from the non-evacuation state to the evacuation state.

8. A control system as claimed in claim 1, wherein the system is configured to monitor an egress rate of movement of occupants moving through the stairwell dynamically modifying the schedule if the rate of egress is greater than or less than a standard assumed rate.

9. A control system as claimed in claim 1, further comprising a mobile communication device software application interface and wherein the mobile communication device software application interface is configured to output emergency information to a software application executed by a mobile communication device.

10. A control system as claimed in claim 1, wherein the control system is further configured to dynamically update the evacuation plan based on a rate of egress through a given door into the stairwell and an egress rate of occupants within the stairwell.

11. A method for operating a control system thereby to provide efficient emergency multi-storey building stairwell evacuation in a building, the method comprising:

receiving data derived from monitoring of the locations of building occupants within the building, wherein the monitoring includes:

operating a camera system including a plurality of camera devices, wherein each camera device is positioned thereby to capture image data in a respective field of view, wherein the cameras are position such that the fields of view include: one or more regions at an entrance to the building; and one or more regions on each storey of the building including regions adjacent lift shafts;

maintaining a data store that is configured to maintain data representative of: (i) individual occupants identified within the building; and (ii) for each occupant, a current known location;

operating a computer system that processes data received from the plurality of camera devices, wherein the computer system is configured to:

(i) for each camera, apply a facial recognition process thereby to identify individual specific occupants in the field of view of each camera;

(ii) for each camera, each time an individual specific occupant is identified, update the data store such that for that specific individual occupant the data store records a current known location associated with that camera;

such that the computer system causes the data store to maintain current data representative of a number of occupants on each storey of the building as occupants move between storeys of the building, including via identification of specific individual occupant after they exit elevators;

controlling a stairwell access control subsystem which is configured to: control a state of a plurality of access doors of an evacuation stairwell, wherein for each there is an "evacuation state" in which the door is open for evacuation purposes and a "non-evacuation state" in which the door is closed for evacuation purposes; and operating a computer system to define and implement a dynamic evacuation plan, such that the computer system is configured to:

(i) access the data store thereby to determine a current number of occupants on each storey of the building;

(ii) generate an initial evacuation plan which defines an initial schedule for transitioning the access doors from the non-evacuation state to the evacuation state, wherein the schedule is defined thereby to allot a per-storey evacuation time proportionally between storeys based on the number of occupants on each storey of the building;

(iii) receive data representing egress of persons through a given one of the access doors which is the evacuation state on a given storey of the building;

(iv) dynamically modify the schedule in the case that the data representing egress demonstrates an increase or decrease in evacuation time for the given storey relative to the allotted per-storey evacuation time for that storey currently defined by the evacuation plan, such that the schedule is modified for transitioning a remaining subset of access doors from the non-evacuation state to the evacuation state, wherein the schedule is thereby modified to allot a per-storey evacuation time proportionally between the remaining storeys based on the number of occupants on each of the remaining storeys; and controlling the transition of each of the access doors from the non-evacuation state to the evacuation stats in accordance with the schedule and modified schedule.

12. A method for operating the control system as claimed in claim 11, including controlling a plurality of display panels positioned adjacent access doors of the stairwell, thereby to cause the display panels to display information including time remaining prior to transition from the non-evacuation state to the evacuation state based on the schedule.

13. A method for operating the control system as claimed in claim 11, including ascertaining the identities of the occupants via the camera system that implements facial recognition, wherein a record is created in an occupants table identifying specific occupants having disabilities, such that during an evacuation event the control system sends a notification to emergency personnel alerting the emergency personnel of a location of a disabled building occupant.

14. A method for operating the control system as claimed in claim 11, wherein the evacuation plan stipulates a maximum evacuation time, and wherein the schedule is defined to divide the maximum evacuation time into per storey evacuation allotted times proportionately in accordance with the calculated number of occupants on each storey of the building.

15. A method for operating the control system as claimed in claim 11, including controlling the transitioning to the evacuation state of access doors to the evacuation stairway of certain storeys for a time period proportionate to the respective calculated number of occupants.

16. A method for operating the control system as claimed in claim 11, including controlling the state of access doors to the evacuation stairway in accordance with a configuration setting stipulating the maximum number of access doors that may be open simultaneously.

17. A method for operating the control system as claimed in claim 11, wherein the evacuation plan stipulates the timing and order of the access doors to be successively transitioned from the non-evacuation state to the evacuation state.

18. A method for operating the control system as claimed in claim 11, including monitoring an egress rate of movement of occupants moving through the stairwell dynamically modifying the schedule if the rate of egress is greater than or less than a standard assumed rate.

19. A method for operating the control system as claimed in claim 11, including dynamically update the evacuation plan based on a rate of egress through a given door into the stairwell and an egress rate of occupants within the stairwell.

* * * * *